United States Patent [19]

Fukase et al.

[11] Patent Number: 4,756,356

[45] Date of Patent: Jul. 12, 1988

[54] METHOD FOR CONTROLLING INTERNAL PRESSURE IN MOLD CAVITY IN MOVING-MOLD TYPE CONTINUOUS CASTING MACHINE

[75] Inventors: Hisahiko Fukase, Tokyo; Kunio Matsui; Yutaka Tsuchida, both of Yokohama, all of Japan

[73] Assignees: Ishikawajima-Harima Jukogo Kabushiki Kaisha; Nippon Kokan Kabushiki Kaisha, both of Japan

[21] Appl. No.: 51,837

[22] Filed: May 19, 1987

[30] Foreign Application Priority Data

Jun. 9, 1986 [JP] Japan ..... 61-133167

[51] Int. Cl.[4] ..... B22D 11/18

[52] U.S. Cl. ..... 164/453; 164/155

[58] Field of Search ..... 164/430, 431, 432, 453, 164/479, 481, 155, 449

[56] References Cited

U.S. PATENT DOCUMENTS

| | | | |
|---|---|---|---|
| 3,864,973 | 2/1975 | Petry | 164/481 |
| 4,276,921 | 7/1981 | Lemmens et al. | 164/453 |
| 4,600,047 | 7/1986 | Matoba et al. | 164/453 |

*Primary Examiner*—Kuang Y. Lin

[57] ABSTRACT

In moving-mold type or dual-belt type continuous casting machines, the molten metal static pressure in the mold cavity is detected and the quantity of the molten metal poured through the tundish nozzle into the mold cavity is controlled such that the static pressure in the mold cavity is maintained at a predetermined range in which penetration of the molten metal into the gap between the tundish nozzle and the mold assembly can be avoided.

8 Claims, 2 Drawing Sheets

METHOD FOR CONTROLLING INTERNAL PRESSURE IN MOLD CAVITY IN MOVING-MOLD TYPE CONTINUOUS CASTING MACHINE

BACKGROUND OF THE INVENTION

The present invention relates to a method for controlling internal pressure in a mold cavity in a moving-mold type continuous casting machine for continuously permitting molten metal to be cast into a casting.

In general, in a moving-mold type continuous casting machine, a plurality of block molds a are interconnected with each other in the form of an endless track to thereby provide a mold assembly b as shown in FIG. 1. Such two mold assemblies b are disposed one upon another in spaced apart relationship to define a mold cavity c. A tundish nozzle d is inserted through one opening of the mold cavity c so as to pour molten metal e in the mold cavity c. The mold assemblies b and a solidified casting f are continuously moved toward the other opening of the mold cavity c. In this manner, the continuous casting is carried out.

If molten metal penetrates into a gap defined between a portion of the tundish nozzle d inserted in the mold cavity c and the mold assembly b and solidifies, not only the tundish nozzle d but also the casting f are damaged. Therefore, the gap is to be reduced for prevention of the molten metal from penetrating thereinto.

However, when the above-mentioned gap is extremely reduced, the gap becomes disappearable due to vibrations produced during the movement of the mold assemblies b which are very heavy in weight so that the tundish nozzle d contacts the mold assemblies b and is readily damaged.

Thus, the above-mentioned gap cannot be made too narrow. It is almost impossible in the present state of art to maintain the gap less than 0.15 mm, without the possibility of disappearance due to vibrations, because of limited dimensional accuracies of various mechanical component parts including the tundish nozzle.

It follows therefore that since the gap is practically 0.15 mm at the least, a vertical height between the leading end of the tundish nozzle d and the surface level of molten metal e within a tundish g, i.e., a molten metal static pressure height H is to be lowered to some extent; but in general the height of the surface level of molten metal e in the tundish g is as high as 0.5 m or more.

Furthermore, conventionally the tundish nozzle d is disposed in an inclined position for facilitation of width-drawing of the casting f out of the mold cavity c so that the tundish nozzle d is increased in length correspondingly and the molten metal static pressure height H is further raised.

As a result, conventionally, it is almost impossible to avoid molten metal from penetrating into the gap.

The inventors made extensive studies and experiments to overcome the above problems and found out that the gap δ (in mm) and molten metal static pressure height H (in m) which allow the molten metal to penetrate into the gap due to surface tension have the relationship as shown in FIG. 2.

As is clear from FIG. 2, when the gap is 0.15 mm or more and if the molten metal static pressure height H is 0.3 m or less, no molten metal is allowed to penetrate into the gap.

Thus, the present invention was made based on the fact that the penetration of the molten metal into the gap can be prevented by controlling a molten metal static pressure in the mold cavity c to a level corresponding to molten metal static pressure height H of 0.3 m or less.

Therefore in a moving-mold type continuous casting machine of the type in which a pair of endless-track type block mold assemblies each wrapped on a pair of spaced sprokets are disposed one upon another and spaced apart from each other so that opposing surfaces of the mold assemblies are moved in same direction to define a mold cavity; and molten metal is poured into the mold cavity through a tundish nozzle inserted in the mold cavity, whereby the molten metal is allowed to cool and solidify in the mold cavity into a casting, the present invention provides a method for controlling the internal pressure in the mold cavity of the moving-mold type continuous casting machine of the type described above, comprising the steps of detecting a molten metal static pressure within the mold cavity and then controlling a quantity of molten metal poured into the mold cavity through the tundish nozzle such that the molten metal static pressure within the mold cavity can be maintained at a predetermined level.

Regardless of the height of the surface level of molten metal in the tundish, the quantity of molten metal poured through the tundish nozzle is controlled by, for instance, variable throttling means so that the molten metal static pressure in the mold cavity is always maintained at the predetermined level and the quantity of the molten metal penetrating into the gap between the tundish nozzle inserted in the mold cavity and the opposing surfaces of the endless track type mold assemblies can be reduced to a minimum.

The above and other objects, effects, features and advantages of the present invention will become more apparent from the following description of a preferred embodiement thereof taken in conjunction with the accompanying drawings.

DETAILED DESCRIPTION OF THE PREFERRED EMBODIMENT

Figure 3:
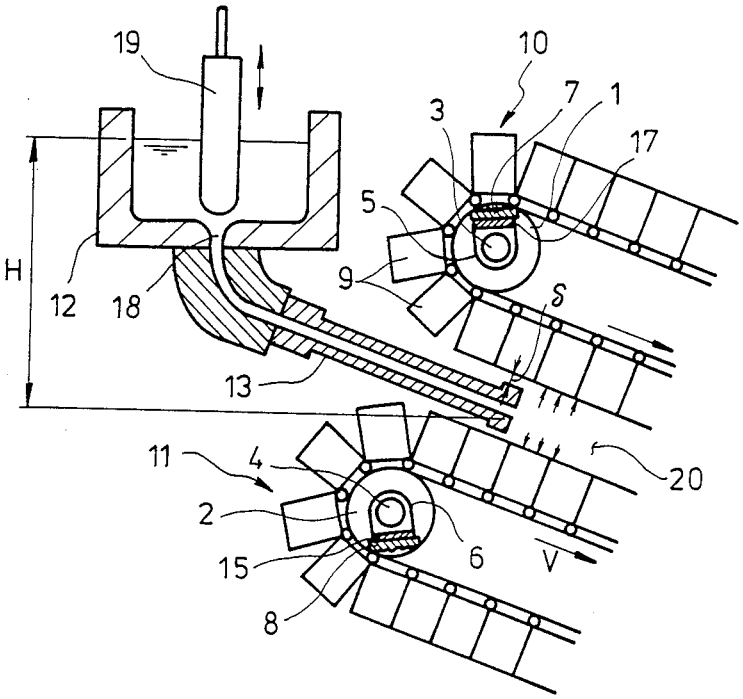
FIG. 3 is a view of a moving-mold type continuous casting machine adapted to carry out the method of the present invention.

FIG. 3 shows a moving-mold type continuous casting machine adapted to carry out the method of the present invention in which reference numerals 1 and 2 represent sprockets; 3 and 4, shafts; 5 and 6, bearings; 7 and 8, frames; 9, block molds; 10 and 11, upper and lower endless-track type mold assemblies; 12, a tundish; and 13, a tundish nozzle. A load cell 15 is interposed between the shaft 4 of the sprocket 2 of the lower mold assembly 11 and the frame 8 upon which is mounted the bearing 6 for supporting the shaft 4, thereby detecting variations (increase or decrease) in load acting on the lower mold assembly 11. In like manner, a load cell 17 is interposed between the shaft 3 of the sprocket 1 of the upper mold assembly 10 and the frame 7 upon which is mounted the bearing 6 for suspendingly supporting the shaft 3, thereby detecting variations in load acting on the upper mold assembly 10.

A throttling valve 19 which can open or close a pouring opening 18 formed through the bottom of the tundish 12 is vertically movably disposed therein. In order to cause the vertical movement of the throttling valve 19, a hydraulic cylinder, a screw rod, a rack mechanism or the like may be used.

The throttling valve 19 is controlled automatically or manually in response to the detection signals delivered from the load cells 15 and 17 such that the molten metal static pressure in the mold cavity 20 is maintained to a predetermined level.

Figure 1:
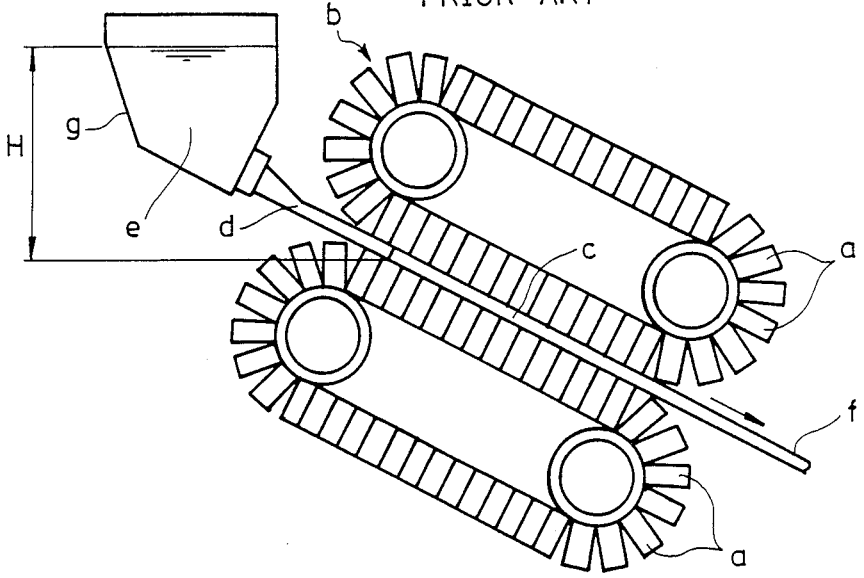
Fig.1 PRIOR ART
FIG. 1 is a view used to explain a conventional moving-mold type continuous casting machine.
Figure 2:
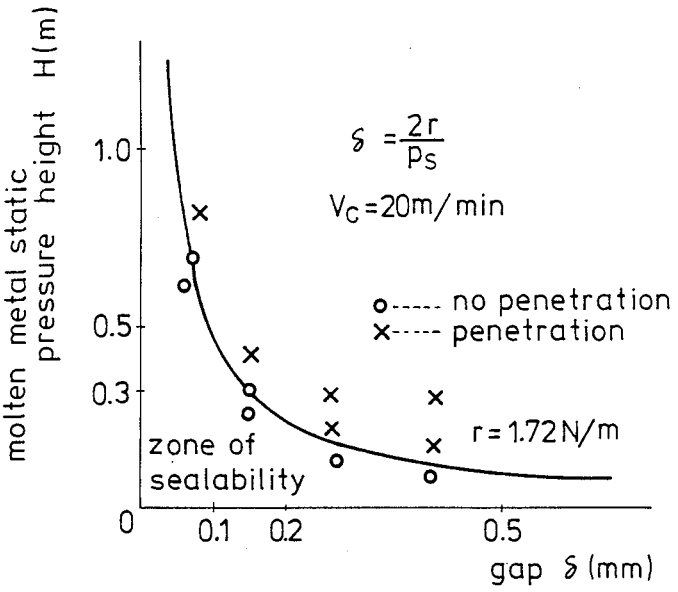
FIG. 2 is a graph illustrating the relationship between the gap defined by the tundish nozzle inserted in the mold cavity and the mold assemblies on the one hand and the molten metal static pressure height on the other hand when the molten metal is allowed to penetrate into the gap and in which Vc, Ps and r respectively denotes a casting velocity, a molten metal static pressure and surface tension.

When the gap $\delta$ between the portion of the tundish nozzle 13 which is inserted in the mold cavity 20 and the surface of the mold cavity 20 is 0.15 mm, the allowable molten metal static pressure height which allows no penetration of the molten metal into the gap is about 0.3 m as obtained from the relationship illustrated in FIG. 2. Therefore, the control resistance $\Delta H_C$ acting on the throttling valve 19 can be calculated from the following relation:

$$H_N = H - \Delta H_N - \Delta H_C$$

where $H_N$: molten metal static pressure in the mold cavity;

H: molten metal static pressure height; and $\Delta H_N$: tundish nozzle resistance.

The tundish nozzle resistance $\Delta H_N$ can be previously detected and the molten metal static pressure height H which varies in response to the variation in quantity of molten metal in the tundish can be measured in practice.

In the case of the continuous casting operation, when the degree of opening of the throttling valve 19 is so adjusted to obtain the control resistance $\Delta H_C$ thus calculated, the molten metal in the tundish 12 is poured into the mold cavity 20 through the molten metal pouring opening 18 at the bottom of the tundish 12 and the tundish nozzle 13.

The pressure load of the molten metal poured into the mold cavity 20 acts on both the upper and lower mold assemblies 10 and 11 and is detected by the load cells 17 and 15 mounted on supporting members of the mold assemblies 10 and 11. The static pressure height $H_N$ thus detected does not always correspond to the allowable static pressure height of 0.3 m due to variations in actual molten metal static pressure height H and other factors so that the degree of opening of the throttling valve 19 is increased or decreased, whereby the control resistance $\Delta H_C$ becomes correspondent to the allowable molten metal static pressure height of 0.3 m.

When the molten metal poured through the tundish nozzle 13 into the mold cavity 20 is too much, the molten metal static pressure in the mold cavity 20 rises above a predetermined level and is detected by the load cells 15 and 17. In response to the increase in molten metal static pressure in the mold cavity 20 thus detected, the degree of opening of the throttling valve 19 is manually or automatically decreased so that the penetration of the molten metal into the gap $\delta$ can be prevented.

On the other hand, when the molten metal poured through the tundish nozzle 13 into the mold cavity 20 is less, no molten metal penetrates into the gap $\delta$, but the casting velocity is decreased. Then in response to the output signals from the load cells 15 and 17, the degree of opening of the throttling valve 19 is increased and consequently the quantity of the molten metal poured into the mold cavity 20 is increased.

It is to be understood that the present invention is not limited to the preferred embodiment described above and that various modifications may be effected without departing the scope of the present invention. The present invention may equally applied to not only the moving-mold type continuous casting machines but also the dual-belt type continuous casting machines.

As described above, according to the method for controlling the internal pressure in the mold cavity of the moving-mold type continuous casting machines of the present invention, the flow rate of the molten metal is controlled in response to the detection of the molten metal static pressure in the mold cavity. Therefore, the molten metal static pressure in the mold cavity can be maintained at a predetermined maximum pressure range without causing the penetration of the molten metal into the gap. As a result, the present invention has remarkable effects that the penetration of the molten metal into the gap can be prevented while a predetermined casting velocity can be maintained.

What is claimed is:

1. A method for controlling internal pressure in a mold cavity of a moving-mold type continuous casting machine of the type in which a pair of endless-track type block mold assemblies each wrapped on a pair of spaced sprockets are disposed one upon another and spaced apart from each other so that opposing surfaces of the mold assemblies are moved in the same direction to define said mold cavity, and in which molten metal is poured into the mold cavity through a tundish nozzle inserted in the mold cavity, whereby the molten metal is allowed to cool and solidify in the mold cavity into a casting, said method comprising the steps of detecting a molten metal static pressure within the mold cavity and then controlling a quantity of molten metal poured into the mold cavity through the tundish nozzle such that the molten metal static pressure within the mold cavity can be maintained at a predetermined level.

2. The method according to claim 1 wherein the molten metal static pressure in said mold cavity is detected by load cell means.

3. The method according to claim 1 wherein the molten metal static pressure in said mold cavity is detected by load cell means each interposed between a shaft of the corresponding sprocket and a supporting frame.

4. The method according to claim 1 wherein said predetermined molten metal static pressure is a maximum molten metal static pressure height which is inherent to a gap between said tundish nozzle and the mold assembly and which allows no penetration of the molten metal into said gap.

5. The method according to claim 1 wherein the quantity of the molten metal poured through said tundish nozzle is controlled by a throttling valve.

6. The method according to claim 5 wherein control resistance $H_C$ acting on said throttling valve is calculated from the following equation $$H_N = H - \Delta H_N - \Delta H_C$$

where $H_N$: molten metal static pressure in the mold cavity;
H: molten metal static pressure height; and
$\Delta H_N$: tundish nozzle resistance.

7. The method according to claim 1 which is applied to dual-belt type continuous casting machines.

8. A method for controlling internal pressure in a mold cavity of a moving-mold type continuous casting machine of the type in which a pair of endless-track type block mold assemblies each wrapped on a pair of spaced sprockets are disposed one upon another and spaced apart from each other so that opposing surfaces of the mold assemblies are moved in the same direction to define said mold cavity, and in which molten metal is poured into the mold cavity through a tundish nozzle inserted in the mold cavity, whereby the molten metal is allowed to cool and solidify in the mold cavity in a casting, said method comprising the steps of detecting a molten metal static pressure within the mold cavity by load cell means each interposed between a shaft of the corresponding sprocket and a supporting frame, calculating control resistance $\Delta H_C$ acting on a throttling valve in said tundish nozzle from the following equation $$H_N = H - \Delta H_N - \Delta H_C$$

where $H_N$: molten metal static pressure in the mold cavity;
H: molten metal static pressure height; and
$\Delta H_N$: tundish nozzle resistance and controlling a quantity of molten metal poured into the mold cavity through the tundish nozzle by said throttling valve so that a maximum molten metal static pressure height which is inherent to a gap between said tundish nozzle and the mold assembly and which allows no penetration of the molten metal into said gap may be maintained.

* * * * *